US008333446B2

(12) United States Patent
Kang

(10) Patent No.: US 8,333,446 B2
(45) Date of Patent: Dec. 18, 2012

(54) APPARATUS FOR PREVENTING LEAKAGE OF COOLING AIR FOR REFRIGERATOR

(75) Inventor: Sang-Hun Kang, Changwon (KR)

(73) Assignee: LG Electronics Inc., Seoul (KR)

( * ) Notice: Subject to any disclaimer, the term of this patent is extended or adjusted under 35 U.S.C. 154(b) by 1025 days.

(21) Appl. No.: 12/302,253

(22) PCT Filed: May 30, 2007

(86) PCT No.: PCT/KR2007/002629

§ 371 (c)(1),
(2), (4) Date: Nov. 24, 2008

(87) PCT Pub. No.: WO2007/139352

PCT Pub. Date: Dec. 6, 2007

(65) Prior Publication Data

US 2009/0139259 A1 Jun. 4, 2009

(30) Foreign Application Priority Data

May 30, 2006 (KR) ..... 10-2006-0048490
Aug. 3, 2006 (KR) ..... 10-2006-0073350
Sep. 6, 2006 (KR) ..... 10-2006-0085923

(51) Int. Cl.
*A47B 96/02* (2006.01)

(52) U.S. Cl. ..... 312/404; 312/408; 312/323; 312/291

(58) Field of Classification Search ..... 312/404, 312/405, 407, 408, 322, 323, 327, 350, 291, 312/401, 271, 273, 274, 276; 49/254, 255, 49/257, 258, 259, 260; 62/382, 465
See application file for complete search history.

(56) References Cited

U.S. PATENT DOCUMENTS 659,105 A * 10/1900 Saner ..... 312/274
1,630,160 A * 5/1927 Bayless ..... 312/291
1,842,708 A * 1/1932 Barnes ..... 126/191
1,963,089 A * 6/1934 Henderson ..... 312/296
2,051,733 A * 8/1936 Moore et al. ..... 62/265
2,062,856 A * 12/1936 Armbruster ..... 312/273
2,124,857 A * 7/1938 MacGrath ..... 312/313
2,127,379 A * 8/1938 Adams ..... 312/291

(Continued)

FOREIGN PATENT DOCUMENTS

JP 61-60082 4/1986

(Continued)

*Primary Examiner* — James O Hansen
*Assistant Examiner* — Daniel Rohrhoff
(74) *Attorney, Agent, or Firm* — Birch, Stewart, Kolasch & Birch, LLP

(57) ABSTRACT

Disclosed is an apparatus for preventing leakage of cooling air in a refrigerator, comprising: a refrigerator main body having a storage chamber for storing food therein; a shelf for dividing the storage space and placing food thereon; an inner door for opening/closing an opened front face of the unit storage space divided by the shelf and preventing the leakage of cooling air; and a guide unit guiding a horizontal-linear reciprocating motion of the inner door as it angularly rotates for opening/closing the opened front face of the unit storage space. Accordingly, the leakage of cooling air in other unit storage spaces can be prevented when food is taken out from one of a plurality of unit storage spaces provided in the storage chamber of the refrigerator, thereby minimizing a temperature change in the storage chamber as well as minimizing the loss of cooling air.

19 Claims, 8 Drawing Sheets

U.S. PATENT DOCUMENTS

| | | | | | |
|---|---|---|---|---|---|
| 2,470,956 | A | * | 5/1949 | Savidge | 62/441 |
| 2,590,028 | A | * | 3/1952 | Miller | 312/323 |
| 2,814,545 | A | * | 11/1957 | Cornish | 312/271 |
| 4,225,203 | A | * | 9/1980 | Goodrode | 312/236 |
| 4,375,907 | A | * | 3/1983 | Vander Kooi et al. | 312/109 |
| 4,441,771 | A | * | 4/1984 | Roesler | 312/322 |
| 4,500,147 | A | * | 2/1985 | Reister | 312/291 |
| 4,600,254 | A | * | 7/1986 | Whalen | 312/323 |
| 4,615,570 | A | * | 10/1986 | Goodman | 312/110 |
| 4,915,460 | A | * | 4/1990 | Nook et al. | 312/138.1 |
| 5,026,130 | A | * | 6/1991 | Wright et al. | 312/323 |
| 5,050,944 | A | * | 9/1991 | Fricano | 312/323 |
| 5,220,790 | A | * | 6/1993 | Allart et al. | 60/435 |
| 5,335,987 | A | * | 8/1994 | Hodge et al. | 312/323 |
| 5,425,577 | A | * | 6/1995 | Gembler | 312/273 |
| 5,431,490 | A | * | 7/1995 | Edwards | 312/116 |
| 5,437,503 | A | * | 8/1995 | Baker et al. | 312/404 |
| 5,524,981 | A | * | 6/1996 | Herrmann et al. | 312/408 |
| 5,737,939 | A | * | 4/1998 | Valence et al. | 62/441 |
| 5,951,134 | A | * | 9/1999 | Braun et al. | 312/405.1 |
| 5,957,558 | A | * | 9/1999 | Quade | 312/323 |
| 7,337,628 | B2 | * | 3/2008 | Okuda et al. | 62/441 |
| 2001/0037605 | A1 | * | 11/2001 | Finke | 49/360 |
| 2002/0113532 | A1 | * | 8/2002 | Hornberger et al. | 312/323 |
| 2004/0177641 | A1 | * | 9/2004 | Kim | 62/441 |
| 2007/0126325 | A1 | * | 6/2007 | Gorz et al. | 312/404 |
| 2009/0139259 | A1 | * | 6/2009 | Kang | 62/441 |

FOREIGN PATENT DOCUMENTS

| | | | |
|---|---|---|---|
| JP | 6-147746 | A | 5/1994 |
| KR | 1990-0006010 | | 6/1990 |
| KR | 1990-0032127 | | 7/1999 |
| KR | 1999-0035671 | | 9/1999 |
| KR | 20-0180354 | | 2/2000 |
| KR | 2001-0047411 | A | 6/2001 |

* cited by examiner

APPARATUS FOR PREVENTING LEAKAGE OF COOLING AIR FOR REFRIGERATOR

TECHNICAL FIELD

The present invention relates to a refrigerator, and more particularly, to an apparatus for preventing leakage of cooling air in a refrigerator which, when food is taken out from one of a plurality of unit storage spaces provided in a storage chamber of a refrigerator, can prevent the leakage of cooling air from other unit storage spaces.

BACKGROUND ART

In general, a refrigerator stores foods such as meat, fish, vegetables, fruits, drinks, and the like in a fresh condition. A refrigerator includes a refrigerator main body having storage chambers such as a freezing chamber, a cooling chamber, a vegetable compartment, etc., a cooling cycle device disposed in the refrigerator main body, and a door mounted at one side of the refrigerator main body and opening/closing the storage space.

In the refrigerator, the cooling cycle device operates when the temperature of the freezing chamber or the cooling chamber is higher than a preset temperature. As the cooling cycle device operates, an evaporator generates cooling air. Then, the cooling air generated by the evaporator is circulated in the storage chambers. While the cooling air is circulated in the storage chambers, the storage chambers can be maintained at the preset temperature.

Refrigerators may be categorized into various types according to the circulation method of cooling air, location of a freezing chamber and a cooling chamber, and the structure of the evaporator.

For instance, there are refrigerator types such as a top freezer type, a side-by-side type, a bottom freezer type, and the like.

In addition, there are refrigerators for storing specific types of food, such as a Kimchi refrigerator, a wine cooler(cellar) or the like.

Recently, refrigerators have become larger in size to meet customer's desires and are equipped with various functions to enhance user's conveniences.

Typically, a plurality of shelves are disposed in the storage space of the refrigerator main body for placing food or containers holding food therein. These shelves are slidably inserted into a plurality of guides respectively provided in the inner side walls of the storage chamber. A space in which food may be placed is formed between each shelf. Hereinafter, the space between each shelf is referred to as a "unit storage space."

Cooling air is supplied to the storage chamber through cool air ducts positioned in the inner wall of the storage chamber of the refrigerator. As the cooling air is introduced to the unit storage spaces formed between each shelf, food placed in the unit storage spaces is kept fresh.

This structure, however, may cause a loss of cooling air since when a user opens the door for opening the storage chamber of the refrigerator to remove food kept in the unit storage spaces of the refrigerator, cooling air filling each unit storage space is discharged to the outside. Besides, freshness of food placed in each of the unit storage spaces may be lost due to a temperature change in each unit storage space.

In particular, for a kimchi refrigerator, if the internal temperature of each unit storage space is greatly changed, kimchi kept in the unit storage spaces is not ripened(fermented) well, and even the taste of well-ripened kimchi is greatly diminished.

DISCLOSURE OF THE INVENTION

Technical Problem

To overcome these problems and in accordance with the purposes of the present invention, as embodied and broadly described herein, there is provided an apparatus for preventing the leakage of cooling air in a refrigerator, which, when food is taken out from one of a plurality of unit storage spaces provided in a storage chamber of the refrigerator, can prevent the leakage of cooling air in other unit storage spaces.

To achieve this and other advantages and in accordance with the purpose of the present invention, as embodied and broadly described herein, there is provided an apparatus for preventing the leakage of cooling air in a refrigerator, including: a refrigerator main body having a storage chamber for storing food therein, a shelf for dividing the storage chamber and for placing food thereon, an inner door for opening/closing an opened front face of the unit storage space divided by the shelf and preventing the leakage of cooling air therefrom, and a guide unit for guiding a horizontal-linear reciprocating motion of the inner door as it angularly rotates for opening/closing the opened front face of the unit storage space.

MODES FOR CARRYING OUT THE PREFERRED EMBODIMENTS

Description will now be given in detail of the apparatus for preventing the leakage of cooling air in a refrigerator of the present invention, examples of which are illustrated in the accompanying drawings.

Figure 1:
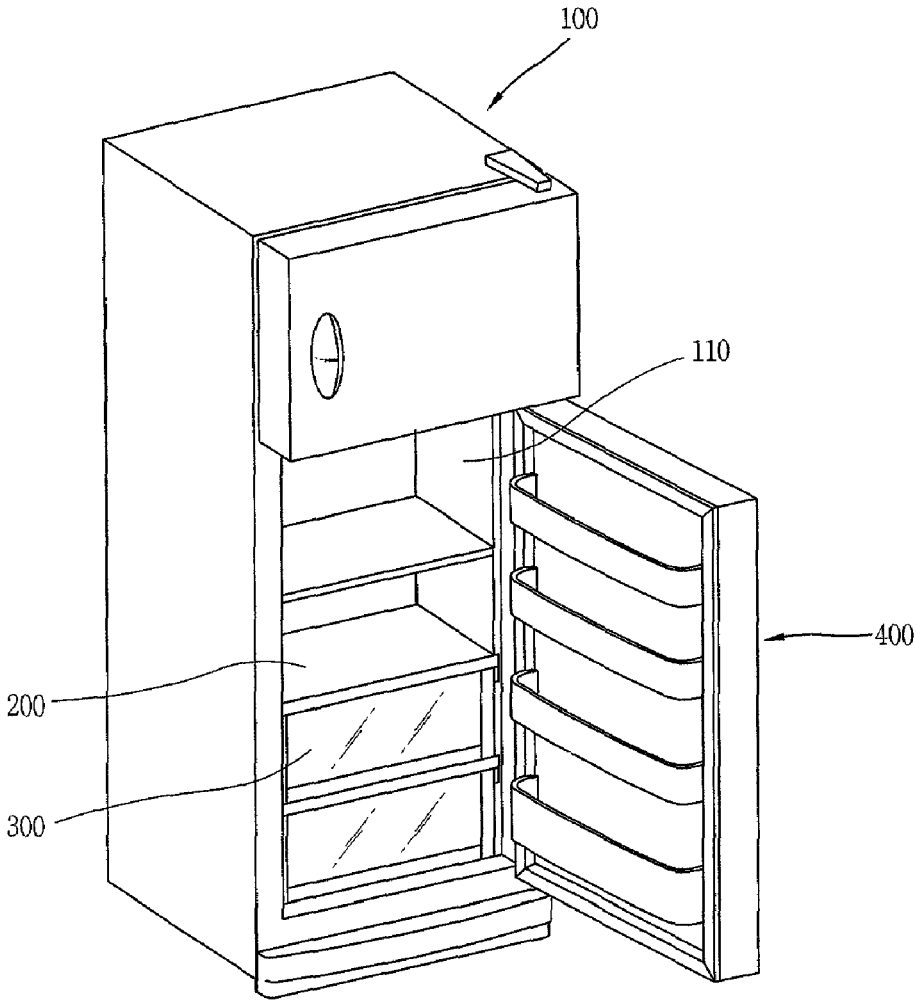
FIG. 1 is a perspective view showing a refrigerator having an apparatus for preventing the leakage of cooling air in a refrigerator according to a first embodiment of the present invention.
Figure 2:
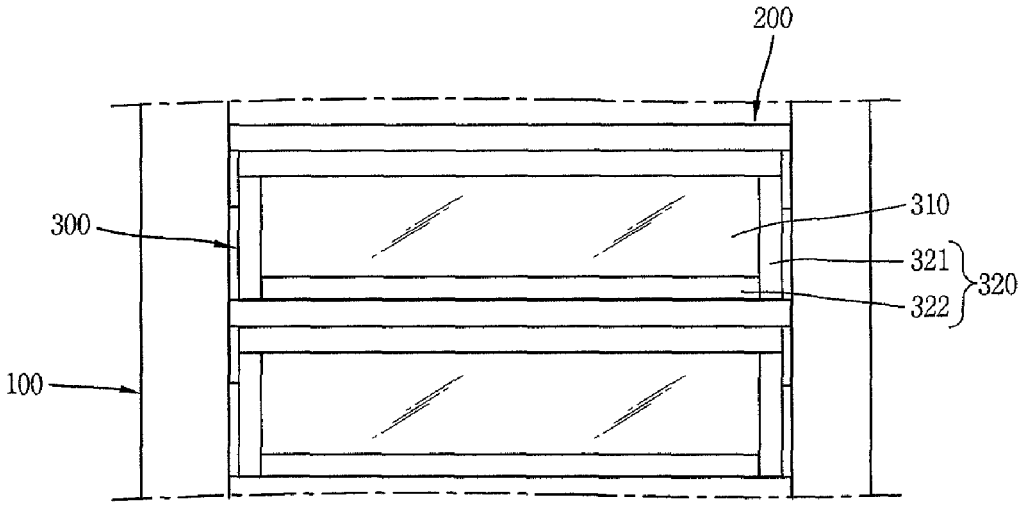
FIG. 2 is a front view showing the apparatus for preventing the leakage of cooling air in a refrigerator.
Figure 3:
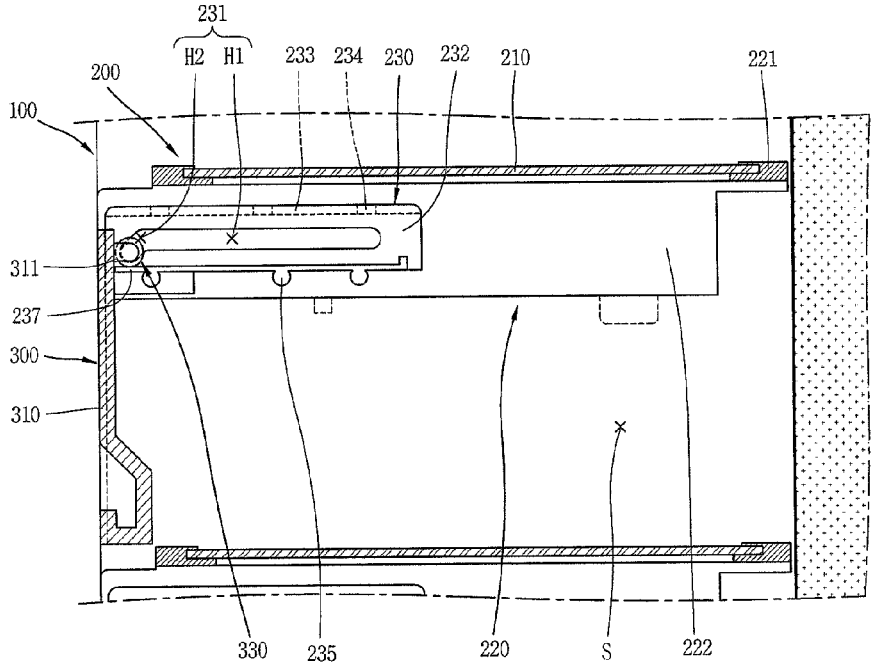
FIG. 3 is a side cross-sectional view showing the apparatus for preventing the leakage of cooling air in a refrigerator.
Figure 4:
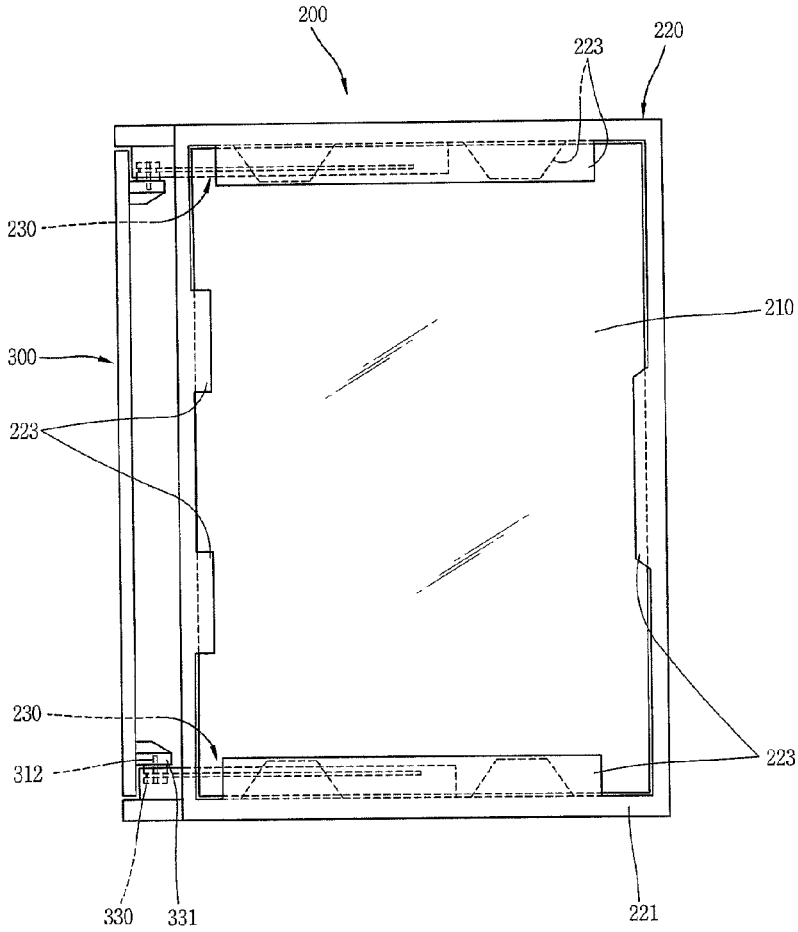
FIG. 4 is a plan view showing the apparatus for preventing the leakage of cooling air in the refrigerator.
Figure 5:
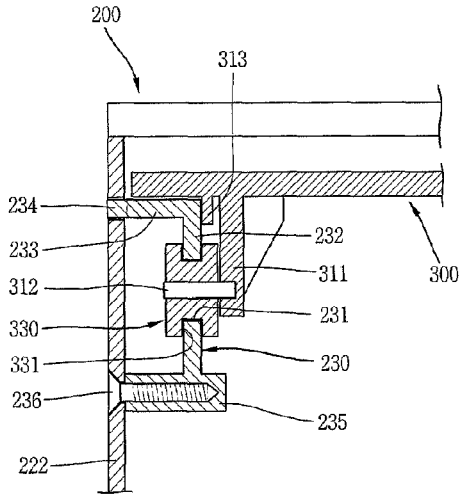
FIG. 5 is a cross-sectional view partially showing the apparatus for preventing the leakage of cooling air in a refrigerator.

FIG. 1 is a perspective view showing a refrigerator having a first embodiment of the apparatus for preventing the leakage cooling air in a refrigerator of the present invention. FIG. 2 is a front view showing the apparatus for preventing the leakage of cooling air in the refrigerator. FIG. 3 is a side cross-sectional view showing the apparatus for preventing the leakage of cooling air in the refrigerator. FIG. 4 is a plan view showing the apparatus for preventing the leakage of cooling air in the refrigerator. And, FIG. 5 is a cross-sectional view partially showing the apparatus for preventing the leakage of cooling air in the refrigerator.

As shown in the drawings, a storage chamber for storing food is provided inside a refrigerator main body 100. The storage chamber can be a freezing chamber, a cooling chamber, a vegetable compartment or the like.

A plurality of shelves 200 for placing thereon food or containers having food therein are disposed in the storage space of the refrigerator main body 100. The storage space is divided into a plurality of storage spaces by the shelves 200. The space between each shelf 200 is referred to as a unit storage space S.

An inner door 300 is mounted at the refrigerator main body or the shelf 200 for opening/closing the unit storage space S as the space between each shelf 200. When the inner door 300 blocks an opened front face of the unit storage space S, cooling air filling the unit storage space S can be prevented from leaking to the outside.

And, a guide unit is provided to guide a horizontal-linear reciprocating motion of the inner door 300 as it angularly rotates and performs an opening/closing of the opened front face of the unit storage space S.

Preferably, the shelf 200, the inner door 300 and the guide unit are formed as one assembly.

The shelf 200 includes a transparent base plate 210 having a rectangular shape, and a frame 220 covering the edges of the transparent base plate 210.

Preferably, the transparent base plate 210 is a glass plate having a certain thickness.

The shelf frame 220 includes a rectangular edge portion 221 for placing the transparent base plate 210 therein, side plate portions 222 respectively depending from both side ends of the edge portion 221, and a plurality of plate fixing portions 223 extending from an inner side surface of the edge portion 221 and fixing the transparent base plate 210. The side plate portions 222 of the shelf frame 220 are disposed on both side inner walls 110 of the storage chamber. One end of each side plate portion 222 is formed to protrude(extend) to the front further than the edge portion 221.

The side plate portions 222 may be connected to the frame 220 by being manufactured as separate components from the frame 220. Preferably, the plate fixing portions 223 are each formed by two protrusions disposed vertically with a certain gap therebetween on an inner surface of the edge portion 221.

A guide member 230 is disposed on an inner wall of each side plate portion 222 of the frame 220. Each guide member 230 includes a plate portion 232 in which a guide slot 231 having a certain length is formed, a guide portion 233 extending from one side of the plate portion 232 and with its outer side surface forming a guide surface, and a coupling portion disposed respectively at an end of the guide portion 233 and the plate portion 232 and fixed to an inner wall of the shelf 200.

The plate portion 232 is formed to have a certain thickness, width and length. The guide slot 231 includes a horizontal portion H1 having a certain width and length, and an inclined portion H2 inclinedly extending from one end of the horizontal portion H1.

The coupling portion includes a plurality of fixing protrusions 234 formed at an edge of the guide portion 233 and coupled into slots (not shown) formed in the side plate portion 222 of the shelf 200, a plurality of bosses 235 extending from another side of the plate portion 232 so as to have a certain length, and screws 236 for securing the bosses 235 to the side plate portion 222 of the shelf 200.

When the shelf 200 is inserted into a storage chamber of the refrigerator main body 100, the guide members 230 are coupled to the side plate portions 222 of the shelf frame 220 so as to be disposed at a front face side of the storage chamber.

A stopper 237 is disposed below the plate portion 232 of each guide member to limit a position of the inner door 300. Preferably, the stoppers 237 protrude from the plate portions 232 to be located below the inclined portions H2 of the guide slots 231. The stoppers 237 may be formed in a stepped form at the lower ends of the inclined portions H2 of the guide slots 231 so as to lock a rear surface of the inner door 300.

Meanwhile, the guide members 230 may be integrally formed with the side plate portions 222 of the frame 220.

The inner door 300 includes a transparent plate 310 having a rectangular shape and a frame 320 covering the edges of the transparent plate 310.

Preferably, the transparent plate 310 is formed of a transparent plastic material and includes a curved lower portion.

The door frame 320 includes side surface edge portions 321 disposed at both sides of the transparent plate 310 and a lower edge portion 322 disposed at the lower edge of the transparent plate 310. The lower edge portion 322 and the curved portion of the transparent plate 310 form a handle. Preferably, the side surface edge portions 321 are formed of an opaque plastic material, and the lower edge portion 322 is formed of an aluminum material.

Figure 6:
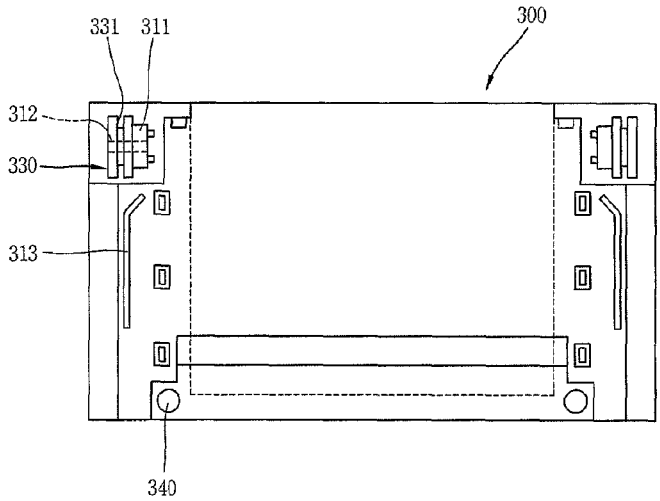
FIG. 6 is a rear view showing an inner door of the apparatus for preventing the leakage of cooling air in a refrigerator.

As shown in FIG. 6, a roller 330 is disposed at both sides of the rear surface of the inner door 300. Preferably, fixing portions 311 protrude from both sides of the rear surface of the inner door 300 with a certain height, a hinge shaft 312 is coupled to each fixing portion 311, and a roller 330 is rotatably coupled to the hinge shaft 312. The fixing portions 311 protrude perpendicularly from the rear surface of the inner door 300. The hinge shafts 312 are configured to be parallel with the rear surface of the inner door 300, and the two hinge shafts 312 are respectively disposed to face the outer sides of the inner door 300.

Preferably, separation-preventing ribs 313 are disposed at both sides of the rear surface of the inner door 300. The separation-preventing ribs 313 are formed to have a certain thickness and length, and protrude from the rear surface of the inner door 300. Each separation-preventing rib 313 is positioned to be aligned with a radial direction of a roller 330.

Preferably, each roller 330 is formed as a cylindrical rod having a certain external diameter and length, and an annular contact groove 331 having a certain width and depth is formed in an outer circumferential surface of the roller 330.

The rollers 330 disposed at both sides of the rear surface of the inner door 300 are positioned in the guide slots 231 of the guide members 230. Here, while the rollers 330 are positioned in the guide slots 231, upper and lower edges of the guide slots 231 contact the contact grooves 331 in the rollers 330.

There is provided a buffer member 340 for absorbing a shock occurring when the inner door 300 closes the unit storage space S. Preferably, a buffer member 340 is provided at each side of the rear surface of the inner door 300.

Figure 7:
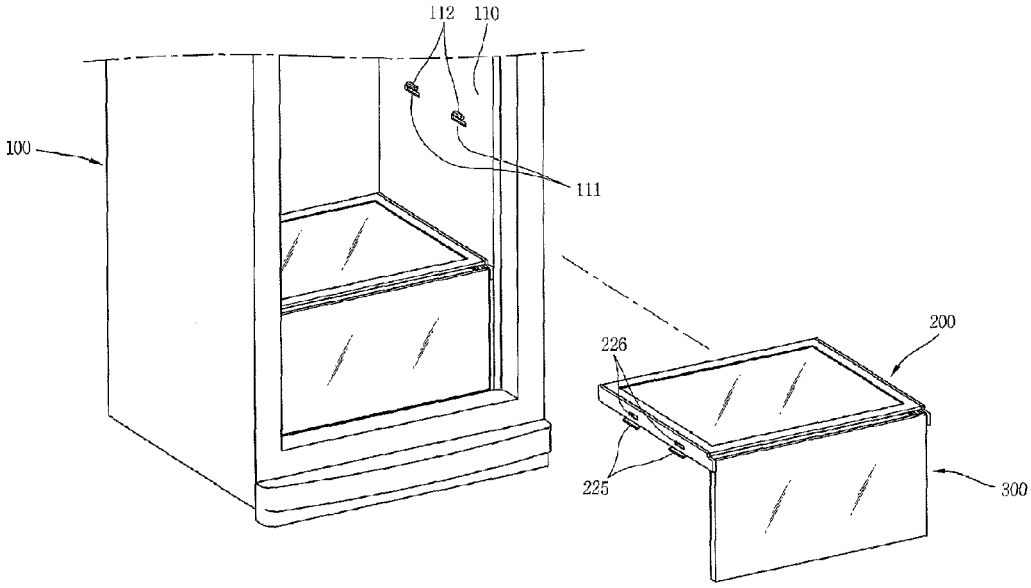
FIG. 7 is a perspective view showing a structure for mounting the apparatus for preventing the leakage of cooling air in a refrigerator.

An assembly of the shelf 200 and the inner door 300 is detachably coupled to the inner wall 110 of the storage chamber of the refrigerator main body 100. For instance, as shown in FIG. 7, a plurality of mounting tabs 225 having a certain shape protrude from the lower portions of both side plate portions 222 of the shelf 200 of the assembly. And a plurality of mounting slots 226 are formed in the side plate portions 222. The mounting tabs 225 are formed to have a certain thickness and area, and preferably are bent.

Further, insertion slots 111 for inserting the mounting tabs 225 of the shelf 200 are formed in the inner wall of the storage chamber of the refrigerator main body 100. And mounting tabs 112 for being inserted into the mounting slots 226 in the shelf 200 are provided above the insertion slots 111.

The mounting tabs 225 of the shelf 200 of the assembly are inserted into the insertion slots 111 formed in both inner side walls 110 of the storage chamber, and the mounting tabs 112 are inserted into the mounting slots 226 in the shelf 200. With this structure, the shelf 200 is detachable from the inner wall 110 of the storage chamber of the refrigerator main body 100.

Figure 8:
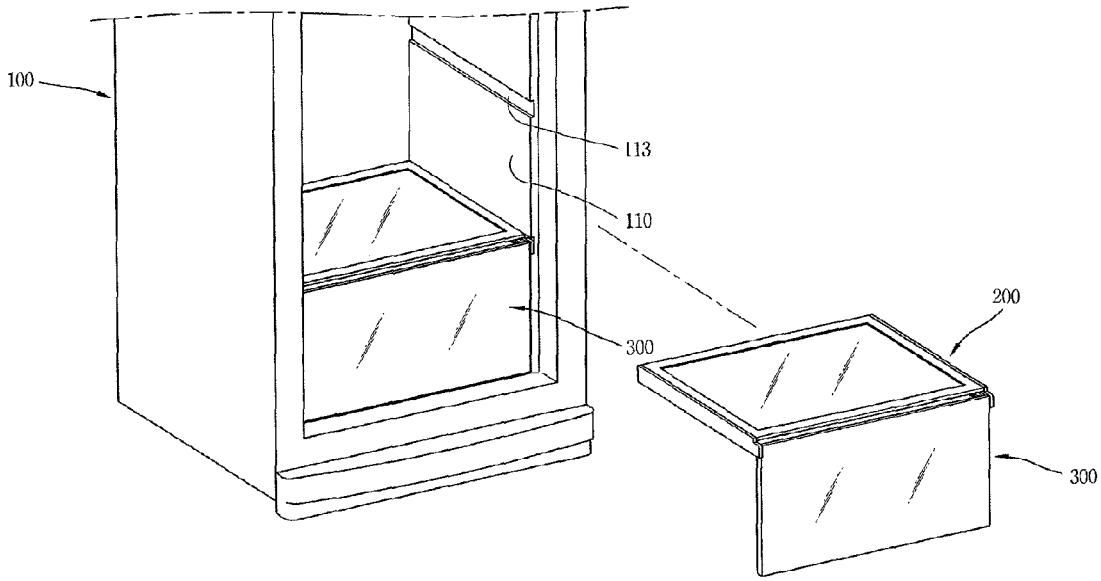
FIG. 8 is a perspective view showing another embodiment of a structure for mounting the apparatus for preventing the leakage of cooling air in a refrigerator.

Meanwhile, the assembly of the shelf 200 and the inner door 300 may be slidably inserted onto both inner side walls 110 of the storage chamber of the refrigerator main body 100. As shown in FIG. 8, for instance, a sliding recess 113 is formed in both inner walls 110 of the storage chamber of the refrigerator main body 100. And, both sides of the shelf 200 of the assembly are horizontally slidably inserted into the sliding recesses 113.

Reference numeral 400 denotes a refrigerator door for opening/closing the storage chamber of the refrigerator main body.

Description of the operation of the apparatus for preventing the leakage of cooling air in a refrigerator of the present invention will be given in detail.

Due to an operation of a cooling cycle system (not shown) provided in the refrigerator main body 100, cooling air is generated from an evaporator (not shown) of the cooling cycle system (not shown). The cooling air is introduced into the storage chamber of the refrigerator main body 100, so each unit storage space S is filled with the cooling air introduced to the storage chamber.

When a user desires to keep food in the refrigerator, the user opens the door mounted at the refrigerator main body 100. Then, the user angularly rotates and horizontally lifts up the inner door 300 blocking an opened front face of a unit storage space S. And, when the inner door 300 being lifted horizontally is pushed to a lower side of the shelf 200, food is then placed in the unit storage space S.

After the inner door 300 positioned at the lower side of the shelf 200 is pulled by a predetermined distance, the inner door 300 is angularly rotated and blocks the opened front face of the unit storage space S. Finally, the storage chamber of the refrigerator main body 100 is closed by the door 400 mounted at the refrigerator main body 100.

To describe the above process in more detail, in a state that the inner door 300 blocks the opened front face of the unit storage space S, as shown in FIG. 3, the rollers 330 of the inner door 300 are disposed in the inclined portions H2 of the guide slots of the guide members 230. The inner door 300 is disposed vertically, with the rollers 330 disposed at the inclined portions H2 of the guide slots acting as an axis, and also blocks the opened front face of the unit storage space S.

Figure 9:
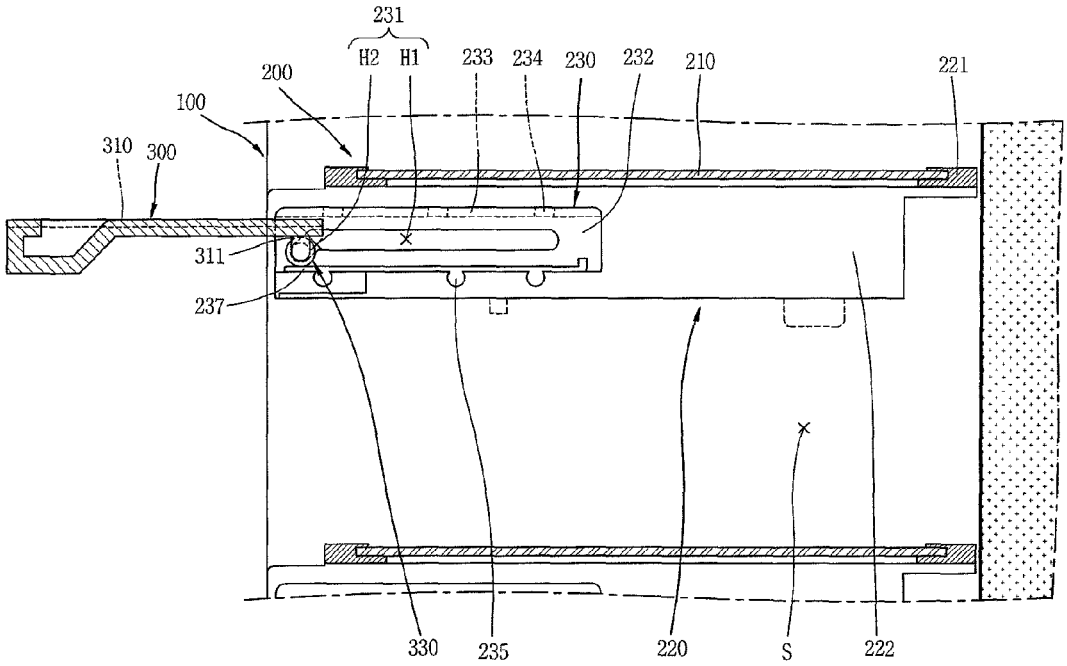
FIG. 9 is a side cross-sectional view showing an operation state of the apparatus for preventing the leakage of cooling air in a refrigerator.

As shown in FIG. 9, when food is placed in the unit storage space S or the food placed in the unit storage space S is taken out, a user holds and lifts up the handle of the inner door 300 and then positions the inner door 300 horizontally. Here, the inner door 300 is horizontally positioned by angularly rotating it around the rollers 330 acting as its axis. In addition, when the inner door 300 being in a horizontal state is pushed, the rollers 330 of the inner door 300 move along the guide slots 231, i.e., the edges of the guide slots 231 (serving as rails) and the inner door 300 is horizontally inserted below the transparent base plate 210 of the shelf 200. Here, the rear surface of the inner door 300 is inserted by being supported by the upper surfaces of the guide portions 233 of the guide members, i.e., the guide surfaces.

When the unit storage space S is to be closed, the user pulls the inner door 300 inserted below the shelf 200. When the inner door 300 is pulled, the rollers 330 of the inner door 300 move along the edges of the guide slots 231, thereby horizontally drawing out the inner door 300. Further, when the rollers 330 of the inner door 300 are positioned at one end of the guide slots 231, i.e., the inclined portions H2, the inner door 300 blocks the opened front face of the unit storage space S, by angularly rotating about the rollers 330 of the inner door 300 as an axis. Here, the inner door 300 is vertically disposed and blocks the opened front face of the unit storage space S.

When the inner door 300 is vertically disposed, the inner door 300 does not angularly rotate further inwardly since it is supported by the stoppers 237 provided at the guide members 230. Preferably, the stoppers 237 are positioned to have an angle between the rear surface of the inner door 300 and the lower surface of the shelf 200 not to be less than 90°.

While the inner door 300 is moved, the separation-preventing members 313 formed at both sides of the rear surface of the inner door 300 each make a surface contact with the side surfaces of the guide members 230. Accordingly, when the inner door 300 moves, vibrations in the right and left directions may be prevented. Further, the stripping of the inner door 300 may be prevented.

In such structure, the guide members 230 mounted at the shelf 200 and the rollers 330 disposed at the inner door 300 and the like form a guide unit by which the inner door 300 moves horizontally as well as opens/closes the opened front face of the unit storage space S while angularly rotating.

Figure 10:
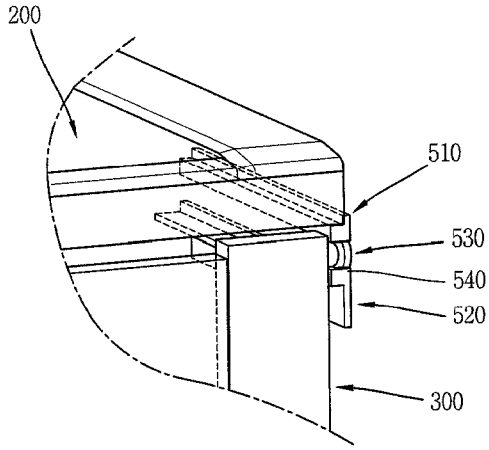
FIG. 10 is a perspective view showing a second embodiment of a guide unit of an apparatus for preventing the leakage of cooling air in a refrigerator of the present invention.

Meanwhile, as shown in FIG. 10, a second embodiment of the guide unit for guiding horizontal moving of the inner door 300 for opening/closing the unit storage space S while angularly rotating includes upper guide members 510 coupled to both inner walls of the shelf 200 or the inner wall 110 of both sides of the storage chamber with a space therebetween, a lower guide members 520 disposed below the upper guide members 510 with a certain distance therebetween, and rollers 530 rotatably coupled to both side surfaces of the inner door 300 and coupled to be linearly movable between the upper guide members 510 and the lower guide members 520.

Preferably, the upper guide members 510 and the lower guide members 520 are formed to be curved such that the rollers 530 may move therebetween without being separated, and stopping jaws 540 are formed at both ends of the upper guide members 510 or the lower guide members 520 so as to prevent the separation of the rollers 530.

Figure 11:
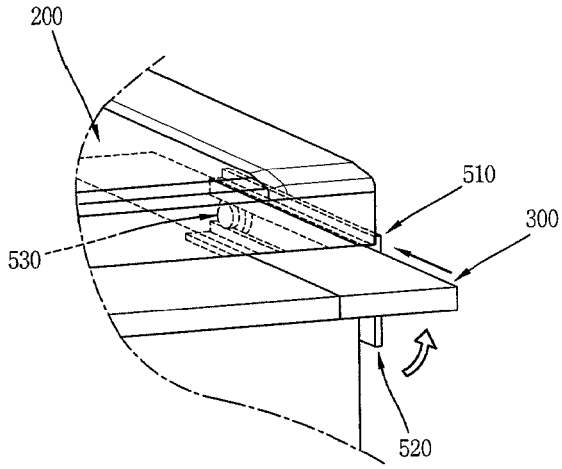
FIG. 11 is a perspective view showing an operation state of the second embodiment of a guide unit of the apparatus for preventing the leakage of cooling air in a refrigerator of the present invention.

In the above-described structure, the inner door 300 is vertically positioned while blocking the opened front face of the unit storage space S. And, when food is placed in the unit storage space S or food stored in the unit storage space S is taken out, the inner door 300 is lifted up and placed horizontally by making the rollers 530 of the inner door 300 act as an axis. Referring to FIG. 11, when the inner door 300 being horizontally positioned is pushed, the inner door 300 is inserted below the shelf 200 while each of the rollers 530 moves along the upper guide members 510 and the lower guide members 520.

When the opened front face of the unit storage space S is to be closed, and if the inner door 300 is horizontally pulled, the inner door 300 is horizontally drawn while the rollers 530 move along the upper guide members 510 and the lower guide members 520. And, the inner door 300 is angularly rotated about the rollers 530 as an axis, thereby blocking the opened front face of the unit storage space S.

Figure 12:
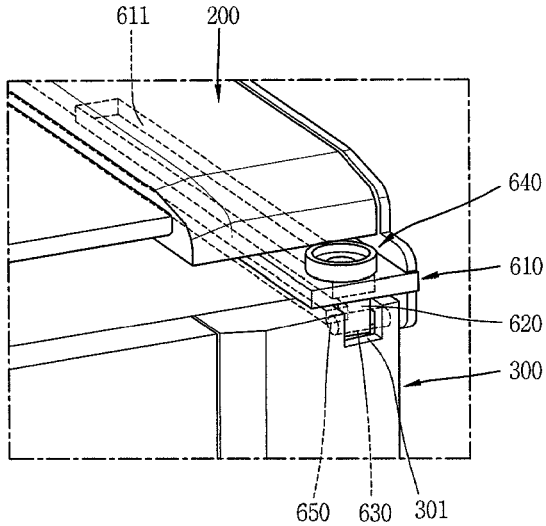
FIG. 12 is a perspective view showing a third embodiment of a guide unit of an apparatus for preventing the leakage of cooling air in a refrigerator of the present invention.

FIG. 12 is a perspective view showing a third embodiment of the guide unit. As shown in the drawing, the third embodiment of the guide unit includes guide members 610 each having a guide slot 611 therein and respectively coupled to the inner wall of both sides of a shelf 200 or to the inner wall 110 of both sides of the storage chamber, coupling members 620 penetratingly inserted into the guide slot 611 of each guide member 610, hinge shafts 630 penetratingly inserted into one end of each coupling member 620 and rotatably coupled to the inner door 300, and rollers 640 rotatably coupled to the other ends of each coupling member 620 and rotating by being contacted with the side surfaces of the shelf 200 or the side walls of the storage chamber.

Each guide member 610 is configured to have the guide slot 611 inside a plate having a certain thickness, width and length. The guide slot 611 is formed to have a certain width and length. The guide member 610 is positioned below the shelf 200 so as to be horizontally disposed.

A sliding support member 650 is positioned at a lower side of each guide member 610 with a certain distance therebetween. The sliding support member 650 is formed to have a certain area and length, and may be integrally formed with the guide member 610.

Preferably, each coupling member 620 is formed as a cylindrical rod having a certain length. A rectangular recess 301 having a certain width and depth is formed in both ends of the inner door 300. One end of the coupling member 620 is inserted into the recess 301. Further, the hinge shaft 630 is fixed to both walls of the recess 301 in the inner door 300 by penetrating the end of the coupling member 620. The hinge shaft 630 is rotatably inserted into the coupling member 620.

Each roller 640 is formed as a cylindrical rod having a certain external diameter and length. A side surface of the roller 640 makes a surface-contact with the guide member 610, and an outer circumferential surface of the roller 640 contacts the side surface of the shelf 200 or the inner wall 110 of the storage space. Preferably, an elastic band for increasing a frictional force is provided on the outer circumferential surface of the roller 640. Preferably, the elastic band is formed of a rubber material.

With such structure, while the inner door 300 is vertically disposed, the inner door 300 blocks the opened front face of the unit storage space S. Here, the coupling member 620 is also vertically disposed. And, when food is placed in the unit storage space S or when food stored in the unit storage space S is taken out, the inner door 300 is lifted up and horizontally disposed, with the hinge shaft 630 inserted into the coupling member 620 acting as an axis. Then, when the inner door 300 being horizontally disposed is pushed, the inner door 300 is inserted below the shelf 200 while the rollers 640 rotate by contacting the inner side surfaces of the shelf 200 or the inner walls 110 of the storage chamber. The inner door 300 moves by slidingly-contacting the sliding support members 650 and also is supported by the sliding support members 650.

When the opened front face of the unit storage space S is to be closed, and if the inner door 300 is horizontally pulled, the inner door 300 is horizontally drawn while the rollers 640 rotate. Then, the inner door 300 is angularly rotated about the hinge shaft 630 as an axis, thereby blocking the opened front face of the unit storage space S. Preferably, the inner door 300 is supported by the ends of the sliding support member 650 so as to prevent an angle between the rear surface of the inner door 300 and the lower surface of the shelf 200 from being less than 90°.

Figure 13:
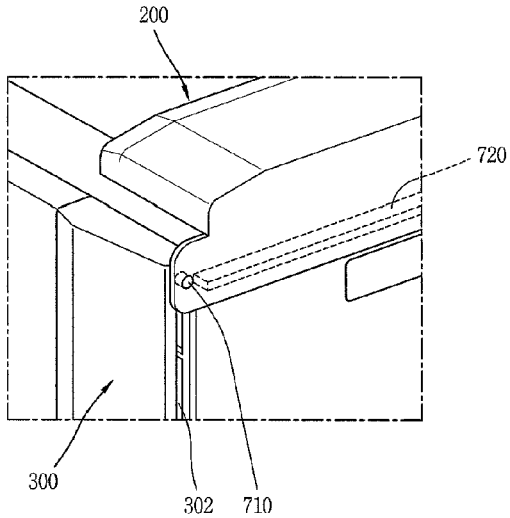
FIG. 13 is a perspective view showing a fourth embodiment of a guide unit of an apparatus for preventing the leakage of cooling air in a refrigerator of the present invention.

FIG. 13 is a perspective view showing a fourth embodiment of the guide unit. As shown, the fourth embodiment of the guide unit includes guide grooves 302 respectively formed in both side surfaces of the inner door 300 so as to have a certain length, and fixed guide protrusions 710 provided on both inner walls of the shelf 200 or both inner walls 110 of the storage space and inserted into the guide grooves 302 in the inner door 300.

When the inner door 300 is inserted to the lower side of the shelf 200, there are provided sliding support members 720 for supporting the inner door 300.

With this structure, in a state that the inner door 300 is vertically disposed, the inner door 300 blocks the opened front face of the unit storage space S. Here, the fixed guide protrusions 710 are disposed in one end of the guide grooves 302 in the inner door. And, when food is placed in the unit storage space S or when food stored in the unit storage space S is taken out, the inner door 300 is lifted up and horizontally disposed, by making the fixed guide protrusions 710 act as an axis. Then, when the inner door 300 being horizontally disposed is pushed, the inner door 300 is inserted below the shelf 200. Here, the horizontal movement of the inner door 300 is guided by the fixed guide protrusions 710 being inserted into the guide grooves of the inner door 300. In addition, the inner door 300 moves by slidingly-contacting the sliding support members and also is supported by the sliding support members 720.

When the opened front face of the unit storage space S is to be closed, the inner door 300 is horizontally pulled out and drawn. And, while the fixed guide protrusions 710 are disposed in an end of the guide grooves 302 in the inner door 300, the inner door 300 is angularly rotated about the fixed guide protrusions 710 act as an axis, thereby blocking the opened front face of the unit storage space S. Preferably, the inner door 300 is supported by the ends of the sliding support members 720 so as to prevent an angle between the rear surface of the inner door 300 and the lower surface of the shelf 200 from being less than 90°.

Figure 14:
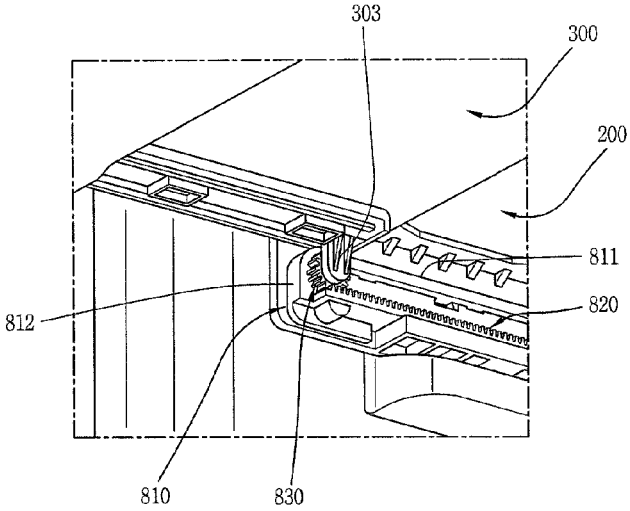
FIG. 14 is a perspective view showing a fifth embodiment of a guide unit of an apparatus for preventing the leakage of cooling air in a refrigerator of the present invention.

FIG. 14 is a perspective view showing a fifth embodiment of the guide unit. As shown, the fifth embodiment of the guide unit includes guide members 810 respectively fixed to both inner walls of the shelf 200 or both inner walls 110 of the storage chamber, racks 820 respectively fixed to a side surface of each guide member 810, pinions 830 rotating by being engaged with each rack 820, and a connecting shaft (not shown) rotatably penetratingly-inserted into each pinion 830 and fixed to a rear surface of the inner door 300.

Each guide member 810 is formed to have a certain length. A guide surface 811 is disposed on an upper surface of the guide member 810, and the rack 820 is fixed to a side surface of the guide member 810. Teeth of the rack 820 are fixed to the guide member 810 so as to be disposed horizontally.

A fixing portion 303 protruding perpendicularly from the rear surface of the inner door 300 is disposed at both sides of the rear surface of the inner door 300. A connecting shaft is fixed to each fixing portion 303. The connecting shaft is disposed horizontally, and the pinion 830 is rotatably coupled to the connecting shaft.

With this structure, in a state that the inner door 300 is vertically disposed, the inner door 300 blocks the opened front face of the unit storage space S. And, when food is placed in the unit storage space S or when food stored in the unit storage space S is taken out, the inner door 300 is lifted up and horizontally disposed, by making the connecting shafts act as an axis. Then, when the inner door 300 being horizontally disposed is pushed, the inner door 300 is inserted below the shelf 200 while the pinions 830 coupled to the inner door 300 rotate by being engaged with the racks 820. The inner door 300 moves by slidingly-contacting the guide surfaces 811 of the guide members 810 and also is supported by the guide surfaces 811 of the guide members 810.

When the opened front face of the unit storage space S is to be closed, if the inner door 300 is horizontally pulled, the inner door 300 is horizontally drawn while the pinions 830 rotate by being engaged with the racks 820. And, the inner door 300 is angularly rotated by making the connecting shafts coupled to the pinions 830 act as an axis, thereby blocking the opened front face of the unit storage space S. Here, the inner door 300 is supported by a vertical front surface 812 of each guide member 810 so as to prevent an angle between the rear surface of the inner door 300 and the lower surface of the shelf 200 from being less than 90°.

Figure 15:
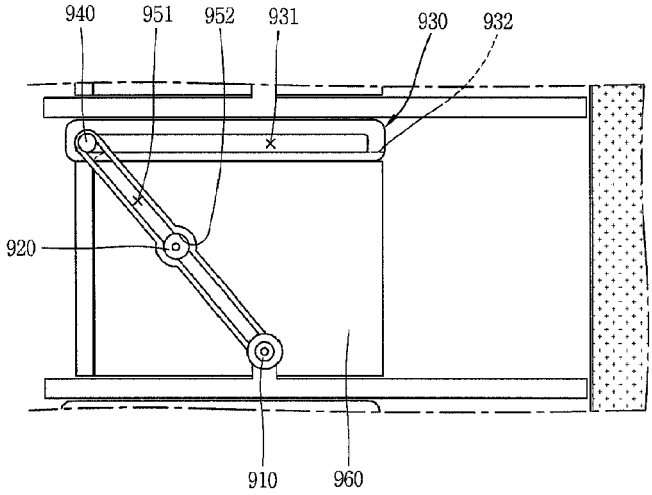
FIG. 15 is a side view showing a sixth embodiment of a guide unit of an apparatus for preventing the leakage of cooling air in a refrigerator of the present invention.

FIG. 15 is a side view showing a sixth embodiment of the guide unit. As shown, the sixth embodiment of the guide unit includes lower shafts 910 respectively disposed at both sides of the shelf 200, middle shafts 920 respectively coupled to both inner walls of the unit storage space S so as to be disposed above the lower shafts 910, guide members 930 each having a guide groove therein and respectively fixed to both inner walls 110 of the unit storage space S so as to be disposed above the middle shafts 920, door shafts 940 respectively fixed to both side surfaces of the inner door 300 and inserted into the guide grooves 931 in the guide members 930, and connecting links 950 for connecting the lower shafts 910, the middle shafts 920 and the door shafts 940 and moving the inner door 300 according to movement of the shelf 200.

The shelf 200 is slidably inserted into the inner wall 110 of the storage chamber of the refrigerator, and the lower shafts 910 are disposed at a middle portion of the shelf 200.

The guide members 930 are formed to have a certain width and length, and the guide grooves 931 are penetratingly formed inside the guide members 930. The guide grooves 931 are formed to have a certain width and length. A support rib 932 having a certain width and length is formed below each guide groove 931. The support rib 932 is horizontally disposed. The guide members 930 are fixed to the inner wall 110 of the unit storage space S so as to dispose the guide slots 931 horizontally.

Each connecting link 950 is formed to have a certain thickness and length. And, a guide slot 951 is formed inside each connecting link 950 to receive the lower shaft 910, the middle shaft 920 and the door shaft 940. Each guide slot 951 is formed to have a certain width and length, and a circular portion 952 is disposed at a central portion of the connecting link 950 for rotation of the middle shaft 920. Preferably, both ends of the guide slots 951 are rounded.

Preferably, shielding plates 960 are respectively provided at both sides of the unit storage space S so as to cover components such as the connecting links 950 and the like.

With this structure, in a state that the inner door 300 is vertically disposed, the inner door 300 blocks the opened front face of the unit storage space S. Here, the upper ends of the connecting links 950 are inclined to be disposed at the front surface of the inner door 300. The door shafts 940 are positioned at one end of the guide grooves 931 of the connecting links 950, and the lower shafts 910 are positioned at another end of the guide grooves 931.

Figure 16:
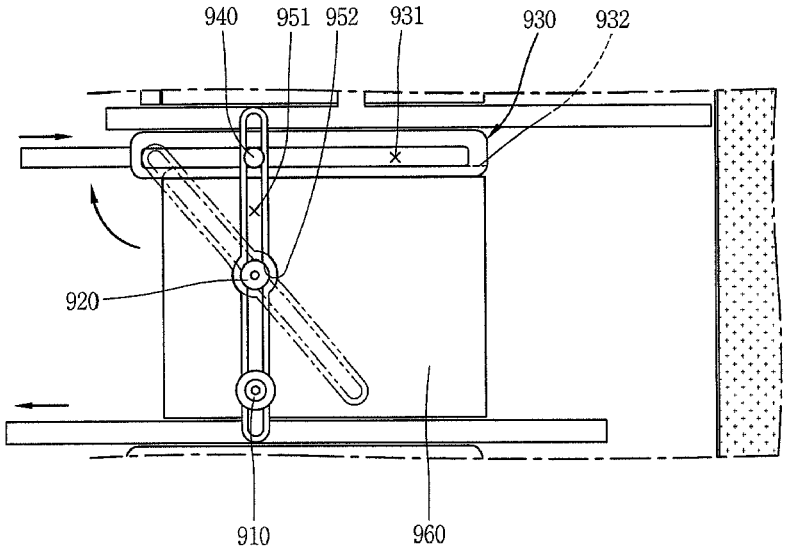
FIGS. 16 and 17 are side views respectively showing operation states of the sixth embodiment of the guide unit of the apparatus for preventing the leakage of cooling air in a refrigerator of the present invention.
Figure 17:
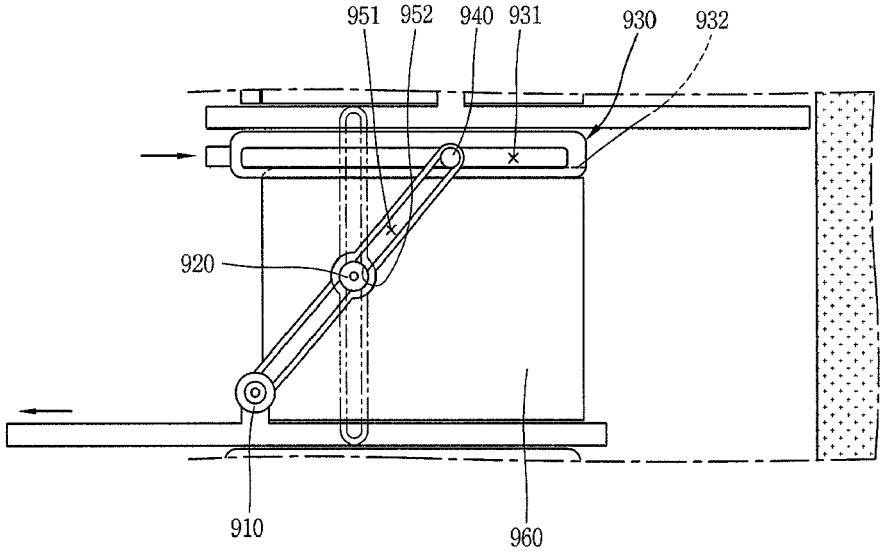

And, when food is placed in the unit storage space S or when food stored in the unit storage space S is taken out, the inner door 300 is lifted up and horizontally disposed, by making the door shafts 940 act as an axis. As shown in FIGS. 16 and 17, when the inner door 300 being horizontally disposed is pushed, the inner door 300 is inserted below the shelf 200. At the same time, the door shafts 940 of the inner door 300 push the connecting links 950, and the connecting links 950 rotate centering around the middle shafts 920. Since the connecting links 950 push the lower shafts 910 while rotating centering around the middle shafts 920, the shelf 200 is pushed forward. Here, the upper ends of the connecting links 950 are inclined to be disposed at an inner side of the unit storage space S. The inner door 300 moves by slidingly-contacting the support ribs 932.

When the opened front face of the unit storage space S is to be closed, the inner door 300 is horizontally pulled. When the inner door 300 is pulled, the door shafts 940 pull the connecting links 950, and the connecting links 950 reversely rotate centering around the middle shafts 920. As the connecting links 950 reversely rotate centering around the middle shafts 920, the connecting links 950 push the lower shafts 910 to the inner side of the unit storage space S, thereby moving the shelf 200 toward the inner side of the unit storage space S. In a state that the inner door 300 is fully pulled, the inner door 300 is angularly rotated about the door shafts 940 acting as an axis, thereby blocking the opened front face of the of the unit storage space S.

Here, the inner door 300 is supported by the end surfaces of the support ribs 932 so as to prevent an angle between the rear surface of the inner door 300 and the lower surface of the shelf 200 from being less than 90°.

With this structure, the shelf 200 is pulled forward or pushed backward while the inner door 300 opens/closes the unit storage space S. Thus, it facilitates taking out food placed on the shelf 200 or placing food on the shelf 200.

Further, in this structure, as the shelf 200 is pulled forward or pushed backward, the inner door 300 opens/closes the opened front face of the unit storage space S while angularly rotating by making the door shafts 940 act as an axis. The inner door 300 is then inserted or pulled from below the shelf 200. This operating principle is the same as described above.

Description of various embodiments of the guide unit of the apparatus for preventing the leakage of cooling air in a refrigerator of the present invention has been given in detail. The guide unit, however, may be implemented in various ways.

Figure 18:
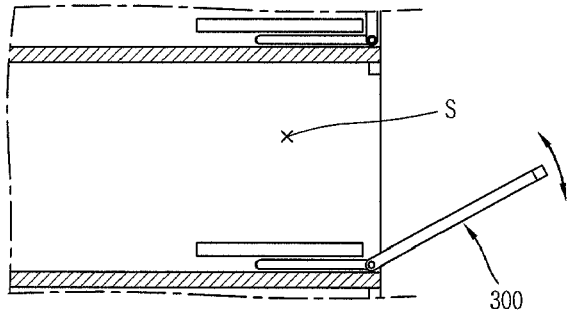
FIG. 18 is a side view showing another embodiment of an inner door of an apparatus for preventing the leakage of cooling air in a refrigerator of the present invention.

Meanwhile, the above embodiment has a structure that the inner door 300 for opening/closing the unit storage space S is opened from bottom to top based on a shaft positioned above the inner door 300. Referring to FIG. 18, another embodiment has a structure that the inner door 300 may be opened from top to bottom based on a shaft positioned below the inner door 300. Preferably, the upper portion of the inner door 300 may be formed to be detachable from both inner walls 110 of the unit storage space S of the refrigerator main body 100 or be a separate member.

As a second embodiment of the apparatus for preventing leakage of cooling air in a refrigerator of the present invention, the apparatus for preventing the leakage of cooling air in a refrigerator includes a refrigerator main body having a storage chamber for storing food, a shelf for dividing the storage space and disposing food, and an inner door for opening/closing an opened front face of the unit storage space divided by the shelf and preventing the leakage of cooling air inside the unit storage space.

Such structure may be implemented by modifying the shape of the guide slots 231 in the guide members 230 in the structure of the first embodiment of the present invention. That is, only the inclined portions H2 are formed in the guide slots 231 of the guide member 230, excluding the horizontal portions H1.

In the second embodiment of the apparatus for preventing leakage of cooling air in a refrigerator, the inner door 300 is not inserted to the lower side of the shelf 200. Instead, the inner door 300 opens/closes the opened front face of the unit storage space S while angularly rotating based on a shaft positioned above the inner door 300.

Figure 19:
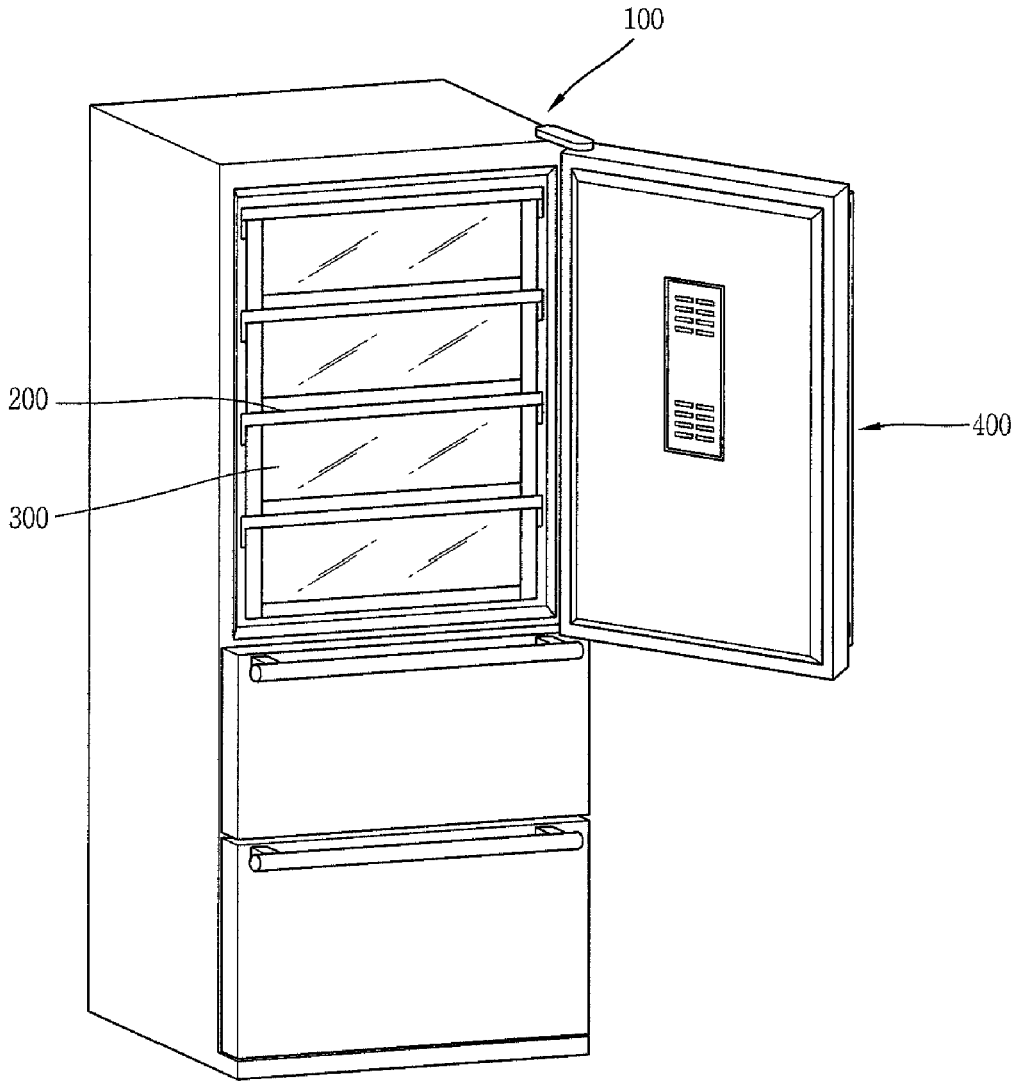
FIG. 19 is a perspective view showing a kimchi refrigerator to which the apparatus for preventing the leakage of cooling air in a refrigerator of the present invention is applied.

FIG. 19 is a perspective view showing an example of a kimchi refrigerator to which the first embodiment or the second embodiment of the apparatus for preventing leakage of cooling air of the present invention is applied.

As shown, a plurality of assemblies each having the shelf 200 and the inner door 300 of the present invention are mounted in the storage space of the kimchi refrigerator main body 100. The plurality of assemblies form a plurality of unit storage spaces inside the storage chamber of the main body 100. And kimchi is stored in each unit storage space.

Reference numeral 400 denotes a refrigerator door.

Hereinafter, description of the operational effect of the apparatus for preventing leakage of cooling air in a refrigerator of the present invention will be given in detail.

In the present invention, shelves are provided in the storage chamber of the refrigerator main body, and inner doors are disposed in each unit storage space of the storage chamber divided by the shelves. Accordingly, the loss of cooling air occurring when food is stored in the storage chamber of the refrigerator or when the stored food is taken out, may be minimized. In addition, food may be stored fresh for a long time by minimizing a temperature change in the storage chamber.

In more detail, when food is stored in the storage chamber of the refrigerator main body or when the stored food is taken out, a user opens the refrigerator door and then opens an inner door of a unit storage space to place food in a unit storage space or to take out food therein. Thus, when the refrigerator door is open, other unit storage spaces are closed by each inner door. Accordingly, the leakage to the outside of cooling air filling the unit storage space is prevented.

Further, in the present invention, the inner door is open/closed by angularly rotating and is also horizontally inserted below the shelf. Accordingly, a user may place food in the unit storage space or take out food therein without holding the inner door, making it easy to use.

In addition, in the present invention, the shelf and the inner door are formed of transparent materials. Thus, when the refrigerator door is open, an empty portion among the unit storage spaces may be easily recognized as well as a unit storage space where food to be taken out is placed may be easily recognized. Accordingly, time taken while a user holds the refrigerator door open is reduced, thereby minimizing the leakage of the cooling air filling the storage chamber of the refrigerator.

In particular, when the present invention is applied to a kimchi refrigerator, a temperature change of each storage space is minimized, thereby accurately controlling temperature. The ripening temperature according to the type of kimchi can be accurately maintained, enabling kimchi to be ripened (fermented) deliciously. Since ripening of kimchi is sensitive to temperature, a preset temperature must be maintained for a delicious taste of ripened kimchi. Besides, the taste of the ripened kimchi may last long when the preset temperature is well maintained.

What is claimed is:

1. An apparatus for preventing leakage of cooling air in a refrigerator, comprising:

a refrigerator main body having a storage chamber for storing food therein;

a shelf for dividing the storage space and placing food thereon;

an inner door for opening/closing an opened front face of the unit storage space divided by the shelf and preventing a leakage of cooling air; and a guide unit for guiding a horizontal-linear reciprocating motion of the inner door as it angularly rotates for opening/closing the opened front face of the unit storage space, wherein the guide unit comprises:

guide members coupled to both sides of the shelf; and rollers rotatably coupled to both ends of the inner door and coupled to the guide members to move linearly along the guide members, wherein each guide member comprises:

a plate portion in which a guide slot having a certain length is formed;

a guide portion extending from one side of the plate portion and having its outer side surface formed as a guide surface; and a coupling portion respectively disposed at an end of the guide portion and the plate portion and fixed to the sides of the shelf, and wherein the coupling portion comprises:

a plurality of fixing protrusions formed at an end of the guide portion and coupled to holes formed in the sides of the shelf;

a plurality of bosses extending from another end of the plate portion so as to have a certain length; and screws coupling the bosses to the sides of the shelf.

2. The apparatus of claim 1, wherein the inner door closes the opened front face of the unit storage space from top to bottom.

3. The apparatus of claim 1, wherein the inner door closes the opened front face of the unit storage space from bottom to top.

4. The apparatus of claim 1, wherein the shelf is formed of a transparent material.

5. The apparatus of claim 1, wherein the shelf comprises a transparent base plate and a frame for covering an edge of the transparent base plate.

6. The apparatus of claim 5, wherein a plurality of plate fixing portions are provided on an inner side surface of the frame, and the transparent base plate is coupled to the plurality of plate fixing portions.

7. The apparatus of claim 1, wherein the inner door is formed of a transparent material.

8. The apparatus of claim 1, wherein the inner door comprises a transparent plate and a frame for covering an edge of the transparent plate.

9. The apparatus of claim 1, wherein the shelf, the inner door and the guide unit are one assembly, and the shelf of the assembly is detachably coupled to an inner wall of the storage chamber.

10. The apparatus of claim 1, wherein the shelf, the inner door and the guide unit are one assembly, and the shelf of the assembly is horizontally slidably coupled to an inner wall of the storage chamber.

11. The apparatus of claim 1, wherein a buffer member is provided for absorbing a shock occurring when the inner door closes the unit storage space.

12. The apparatus of claim 1, wherein the refrigerator is a kimchi refrigerator.

13. The apparatus of claim 1, wherein a separation-preventing rib is disposed at both sides of a rear surface of the inner door.

14. The apparatus of claim 1, wherein a stopper is disposed on both inner walls of the shelf to prevent an angle between a lower surface of the shelf and a rear surface of the inner door from being less than 90° when the inner door angularly rotates on the rollers as an axis.

15. The apparatus of claim 1, wherein the guide slot comprises a horizontal portion having a certain width and length, and an inclined portion extending from one end of the horizontal portion with an inclination.

16. The apparatus of claim 1, wherein a fixing portion is protruded from both sides of the rear surface of the inner door, a hinge shaft is coupled to each fixing portion, and the rollers are rotatably coupled to the hinge shafts.

17. The apparatus of claim 1, wherein an annular contact groove having a certain width and depth is formed in an outer circumferential surface of each roller.

18. An apparatus for preventing leakage of cooling air in a refrigerator, comprising:

a refrigerator main body having a storage chamber for storing food therein;

a shelf for dividing the storage space and placing food thereon;

an inner door for opening/closing an opened front face of the unit storage space divided by the shelf and preventing a leakage of cooling air; and a guide unit for guiding a horizontal-linear reciprocating motion of the inner door as it angularly rotates for opening/closing the opened front face of the unit storage space, wherein the guide unit comprises:

guide members each having a guide slot therein and respectively coupled to both sides of the shelf or of both sides of the storage chamber;

a coupling member penetratingly inserted into the guide slot of each guide member;

a hinge shaft penetratingly inserted into one end of each coupling member and rotatably coupled to the inner door; and a roller rotatably coupled to another end of each coupling member and rotating by being contacted to the sides of the shelf or a side of the storage chamber.

19. The apparatus of claim 18, wherein an elastic band for increasing a frictional force is provided on an outer circumferential surface of each roller.

* * * * *